US011566826B2

(12) United States Patent
Wilkinson et al.

(10) Patent No.: US 11,566,826 B2
(45) Date of Patent: Jan. 31, 2023

(54) MODULAR REFRIGERANT CAP

(71) Applicants: DENSO International America, Inc., Southfield, MI (US); Denso Corporation, Kariya (JP)

(72) Inventors: Marcus Wilkinson, Royal Oak, MI (US); Nikolai Akinin, Canton, MI (US)

(73) Assignees: DENSO International America, Inc., Southfield, MI (US); Denso Corporation

( * ) Notice: Subject to any disclaimer, the term of this patent is extended or adjusted under 35 U.S.C. 154(b) by 106 days.

(21) Appl. No.: 16/689,474

(22) Filed: Nov. 20, 2019

(65) Prior Publication Data

US 2021/0148619 A1 May 20, 2021

(51) Int. Cl.
*F25B 43/00* (2006.01)

(52) U.S. Cl.
CPC ..... *F25B 43/003* (2013.01); *F25B 2345/001* (2013.01); *F25B 2345/002* (2013.01)

(58) Field of Classification Search
CPC ..... F25B 43/003; F25B 2345/001; F25B 2345/002; F25B 2339/0441
See application file for complete search history.

(56) References Cited

U.S. PATENT DOCUMENTS 4,838,901 A * 6/1989 Schmidt ..... B01D 46/0024 55/320
5,215,660 A * 6/1993 Mosher ..... F25B 43/003 210/489
6,176,093 B1 1/2001 Stein et al.
6,330,810 B1 12/2001 Yamazaki et al.
6,474,098 B2 11/2002 Perrine et al.
6,694,773 B1 2/2004 Snow et al.
6,877,336 B2 * 4/2005 Lee ..... B23P 15/26 29/890.05
7,037,393 B2 * 5/2006 Drummond ..... B29C 66/73921 156/69
7,127,908 B2 * 10/2006 Flaugher ..... B01D 53/261 62/271
7,871,023 B2 * 1/2011 Grether ..... B01D 35/04 239/553.3
9,377,228 B2 6/2016 Lee et al.
9,599,414 B2 3/2017 Yin et al.
2005/0178147 A1 * 8/2005 Kaspar ..... F25B 43/003 62/475
2005/0204770 A1 * 9/2005 Bernini ..... F25B 43/003 62/474
2005/0235620 A1 * 10/2005 Connor ..... B01D 46/008 55/498

(Continued)

*Primary Examiner* — David J Teitelbaum
(74) *Attorney, Agent, or Firm* — Dickinson Wright PLLC

(57) ABSTRACT

A filter cap for a body of a refrigerant tank of an automotive HVAC device is provided. The filter cap includes a main body having a rim defining an opening for allowing flow of fluid such as refrigerant. A collar is snap-fit to the cap at the rim. In various embodiments, the collar has a flexible finger that flexes during assembly to the rim, and snaps back into position when fully pressed about the rim. The collar contains a filter membrane between the rim and the collar. The collar has an upper structure such as a plurality of spaced-apart legs. This allows the collar to protect the filter membrane from potential damaging contact while still enabling proper fluid flow through the filter membrane.

15 Claims, 6 Drawing Sheets

(56) References Cited

U.S. PATENT DOCUMENTS

| | | | | |
|---|---|---|---|---|
| 2008/0006052 | A1* | 1/2008 | Ki | F25B 43/006 62/474 |
| 2008/0314252 | A1* | 12/2008 | Min | F25B 43/003 96/151 |
| 2013/0152625 | A1* | 6/2013 | Lee | F25B 43/00 62/474 |
| 2018/0164006 | A1* | 6/2018 | Numasawa | F25B 43/006 |
| 2018/0180336 | A1 | 6/2018 | Iio | |

* cited by examiner

MODULAR REFRIGERANT CAP

TECHNICAL FIELD

The present disclosure relates to a filter cap for a body of a refrigerant tank of an automotive heating, ventilation, and air conditioning (HVAC) device.

BACKGROUND

A cooling circuit used in, for example, a vehicle air-conditioning unit is configured to circulate a refrigerant in passages that extend through an evaporator, a condenser, or the like. Typically, a refrigerant tank is disposed is provided in which refrigerant circulates. The refrigerant tank is configured to temporarily store the refrigerant to separate vapor refrigerant from liquid refrigerant. There can also be a modulator tank in the receiver tank and disposed downstream of the condenser, for example.

Refrigerant may contain water during circulation of the cooling circuit. If such a refrigerant containing water circulates in the cooling circuit, the water may be condensed at an expansion valve, which will lead to occurrence of clogging in the expansion valve. Therefore, it may be beneficial to remove water from refrigerant circulating in the cooling circuit during cooling cycle operation.

The refrigerant tank may also have a desiccant within a bag ("desiccant bag") within the refrigerant tank. The desiccant bag aids in removing water from the refrigerant.

SUMMARY

According to one embodiment, a filter cap for a body of a refrigerant tank of an automotive HVAC device is provided. The filter cap includes a main body including a threaded region configured to mate with a corresponding region of the HVAC device, the main body having a rim defining an opening. A filter membrane covers the opening. A snap-on collar is secured to and fitted about the rim, and at least partially covers the filter membrane to protect the filter membrane.

According to an embodiment, a refrigerant tank for storing a refrigerant of a vehicular HVAC system is provided. The refrigerant tank includes a housing body defining therein a space for storing the refrigerant, a desiccant bag disposed within the space of the housing body, and a filter cap inserted in and secured to the housing body. The filter cap includes a main body having a rim defining an opening through which the refrigerant passes through, a filter membrane covering the opening of the main body, and a collar attached directly to the rim and partially covering the filter membrane to protect the filter membrane.

According to an embodiment, a vehicular HVAC system includes a filter cap configured to screw into a refrigerant tank of a heat exchanger assembly. The filter cap includes a rim about an opening through which refrigerant passes, a filter membrane disposed over the opening and configured to filter contaminants within the refrigerant, and a releasable protective cap covering the filter membrane and releasably attached to the rim of the filter cap.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Terms such as "leading," "front," "forward," "rearward," etc. may be used in this disclosure. These terms are for giving positional context of various components relative to a vehicle in which the heat exchanger resides. For example, the leading or front edge of a component is one that is forward-most in the direction of the front of the vehicle (e.g., the vehicle grille).

Figure 1:
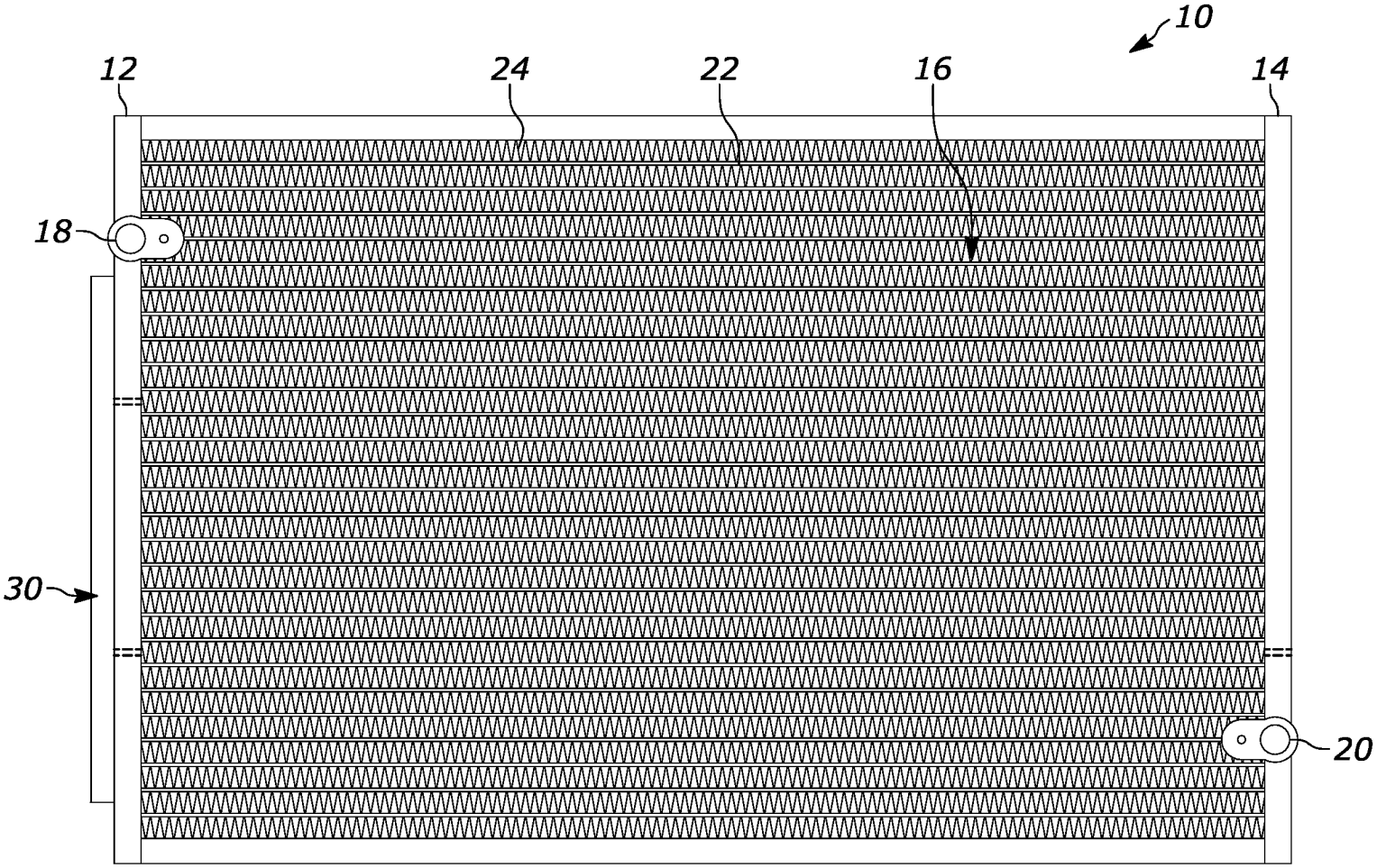
FIG. 1 illustrates shows a front view of a heat exchanger, according to one embodiment.

FIG. 1 shows a front view of a radiator 10 according to one embodiment. The radiator is but one type of heat exchanger that the teachings of this disclosure can be applied to, but for the sake of brevity, only a radiator is illustrated. The heat exchanger could also be a condenser, oil cooler, or other heat exchangers known to be located in front of an engine of an automobile (e.g., car, truck, van, sports utility vehicle, etc.). The radiator 10 includes an inlet header tank 12, an outlet header tank 14, and a core 16 disposed between the inlet header tank 12 and the outlet header tank 14. The inlet header tank 12 defines an inlet 18 through which the coolant enters the radiator 10, and the outlet header tank 14 defines an outlet 20 through which the coolant exits the radiator 10. While the inlet 18 and outlet 20 are shown to exist in opposite header tanks, in other embodiments the inlet is above the outlet in the same header tank. The core 16 includes a plurality of tubes 22 and a plurality of fins 24 which extend between the inlet header tank 12 and the outlet header tank 14. The tubes 22 fluidly connect the inlet 18 to the outlet 20. The tubes 22 and the fins 24 are arranged in parallel in an alternating pattern such that adjacent tubes 22 are connected in parallel via a fin 24.

Coolant from the engine, which may either be a liquid or gaseous phase, flows from the inlet header tank 12, through the core 16, and to the outlet header tank 14. The core 16 cools the coolant flowing through the radiator 10. More specifically, the coolant flows through the tubes 22, and the fins 24 conduct or transfer heat from the coolant flowing through the tubes 22. Heat transferred to the fins 24 is transferred to air flowing through the radiator 10. The air flowing through the radiator can be supplied naturally when the vehicle is traveling, or via a fan (not shown).

The radiator 10 may also include or be coupled with a receiver drier 30. The receiver drier 30 is shown according to one embodiment in FIG. 2, and arrow 30 in FIG. 1 denotes the general location of the receiver drier. The receiver drier 30 stores the coolant and removes moisture and dissimilar substances contained in the coolant. The receiver drier 30 is directly coupled to or within the inlet header tank 12. However, in other embodiments, the receiver drier 30 may be directly coupled to or within the outlet header tank 14. As the coolant flows through one of the header tanks (in this embodiment, the inlet header tank 12), some of the coolant flows through the receiver drier 30 where the coolant can be filtered and desiccated.

Figure 2:
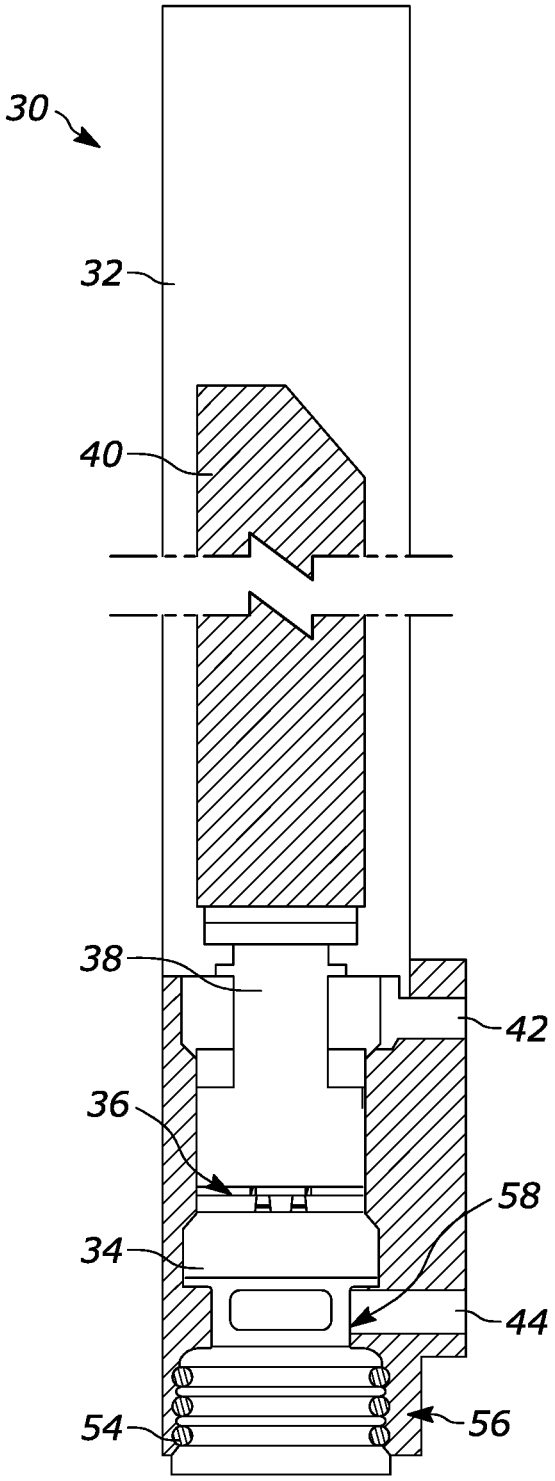
FIG. 2 illustrates a front cross-sectional view of a receiver drier connectable to or part of the heat exchanger, according to one embodiment.

In the embodiment illustrated in FIG. 2, main components of the receiver drier 30 include a body 32, a cap 34, a filter 36, a coupling 38, and a desiccant bag 40. In one embodiment, the body 32 is a hollow tube, and the desiccant bag 40 is inserted into the body 32. The body 32 is also fluidly coupled to one of the header tanks (in this embodiment, the inlet header tank 12) to receive the coolant therefrom. In one embodiment, the lower portion of the body 32 has an inlet 42 that receives the coolant from the inlet header tank 12, and an outlet 44 that sends the coolant to the inlet header tank 12. As the coolant flows from the inlet 42 to the outlet 44, the coolant can be stored in the desiccant bag 40 and/or filtered by passing through filter 36. Filtering the coolant through the filter 36 controls and removes contaminants in the coolant and protects the longevity and performance of thermal expansion valves, the compressor, and other refrigeration system components working with the radiator 10. As will be explained below, the filter 36 may be contained or fixed to the cap 34, such that the coolant flows through the filter 36 at an upper portion of the cap 34, then through the cap 34 and into the outlet 44.

In typical automotive refrigeration systems, the cap is serviceable, in that it can be removed for service. The cap is configured to seal the receiver drier so that the desiccant bag can be serviced and replaced. The cap may also contain the filter. The filter may be at the upper portion of the cap and, if left unexposed, can be prone to damage during shipment. Moreover, different refrigeration systems may have various filtration requirements.

Therefore, according to various embodiments described herein, the cap 34 is designed to utilize a mechanical snap feature to establish one section of the integrated filter cap as a constant across various applications. This mechanical snap feature allows for flexibility for other requirements to be met by attaching differently-shaped components to the cap prior to installation, while minimizing manufacturing costs and tooling associated with creating an array of arrangements to meet different established requirements.

Figure 3A:
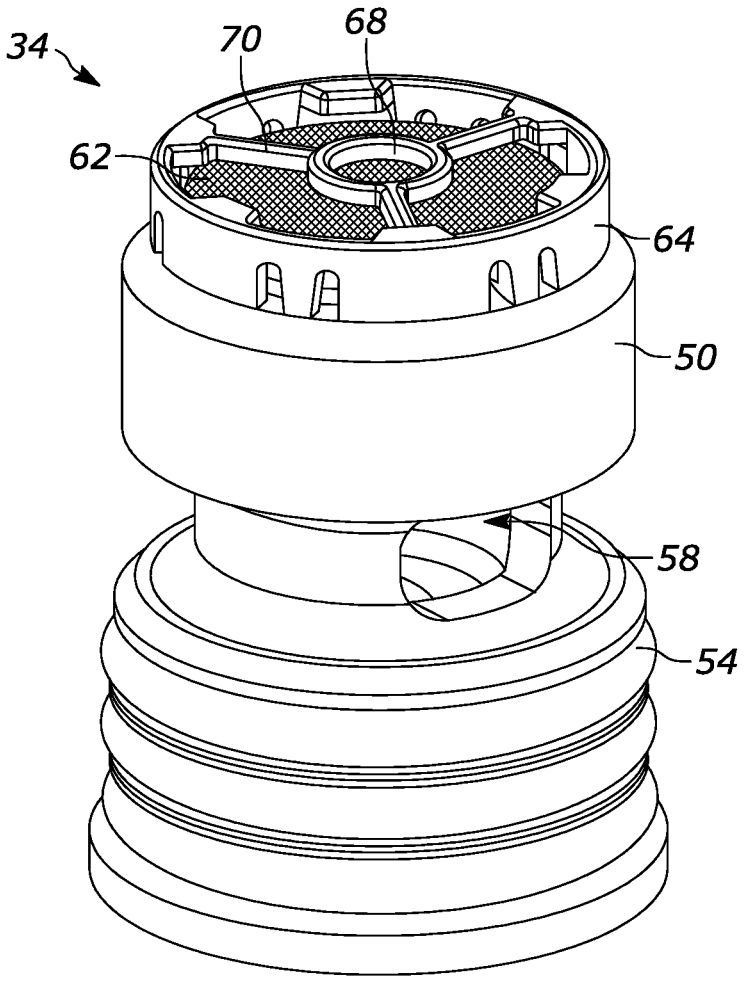
FIG. 3A illustrates a perspective view of a cap for the receiver drier, the cap having a collar containing a filter, according to one embodiment.
Figure 3B:
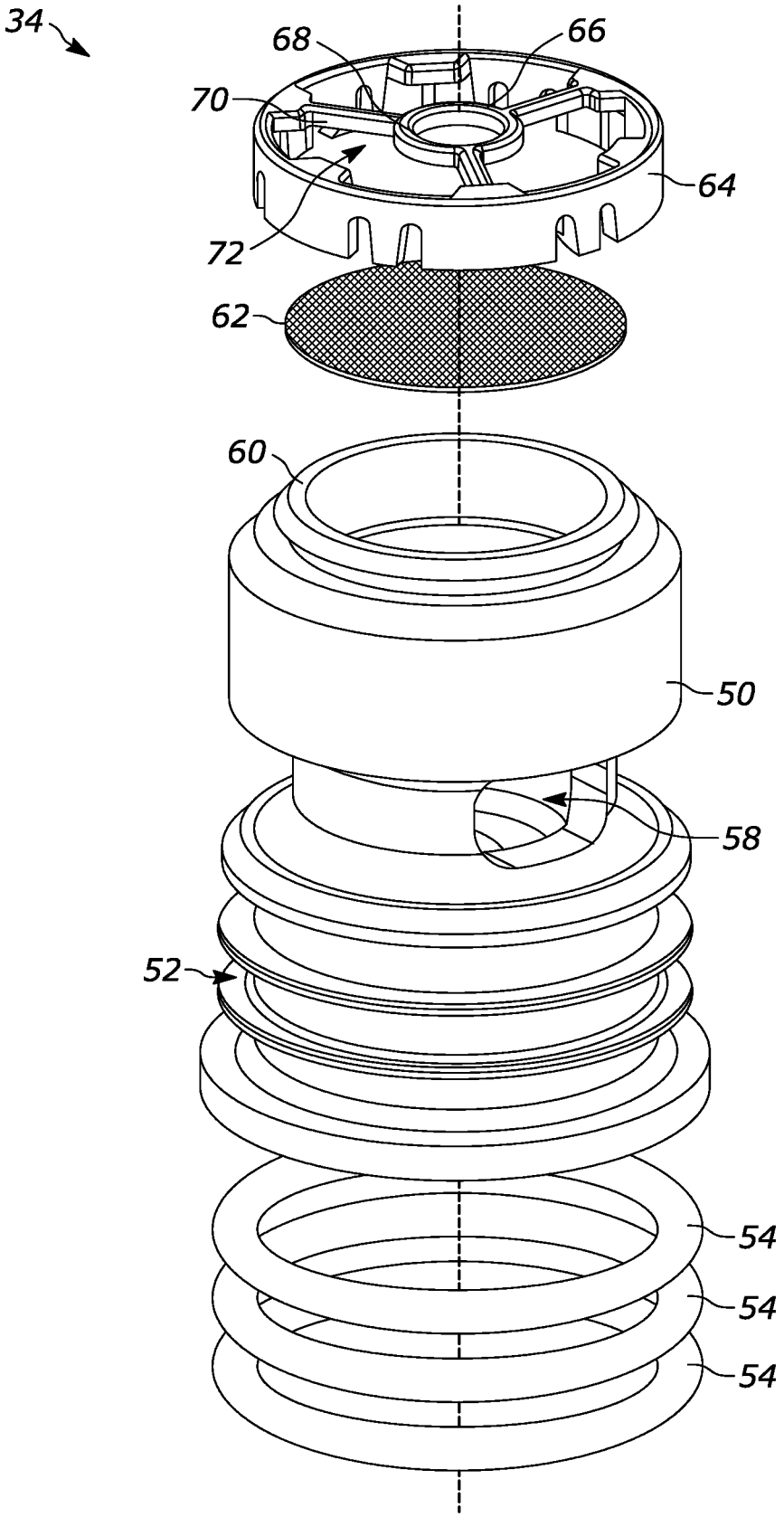
FIG. 3B illustrates an exploded perspective view of the cap of FIG. 3A.

FIG. 3A shows the cap 34 according to one embodiment in an assembled state, and FIG. 3B shows the cap 34 of FIG. 3A in an exploded, disassembled state. A central axis is shown in FIG. 3B; the term "axial" as used herein is intended to refer to a direction along or parallel to this central axis, and the term "radial" as used herein is intended to refer to a direction perpendicular to the axial direction. The cap 34 includes a main body 50. The main body 50 may be made of a plastic or a rubber, such as a thermoplastic resin material, or a thermoplastic elastomer, for example. The main body 50 has one or more annular grooves 52 formed therein that are sized and configured to receive one or more corresponding O-rings 54. The O-rings 54 may be made of a rubber material, for example. When the cap 34 is assembled into position for operation, the O-rings 54 provide a fluid seal between the cap 34 and a corresponding mating part 56 of the header tank. The mating part 56 may be metal such as aluminum, stainless steel, etc. The fluid seal formed at the interface of the O-rings 54 and the mating part 56 inhibit coolant from leaking beneath the header tank. While FIGS. 3A-3B show three O-rings 54 within three corresponding grooves 52, more or less than three O-rings 54 can be utilized.

The main body 50 is also formed with a side port 58. The side port 58 is an opening for the coolant to exit the cap 34 after filtration and/or desiccation. As shown in FIG. 2, the port 58 aligns with the outlet 44 of the body 32 of the receiver drier 30.

The upper region of the main body 50 is provided with an annular rim 60. The rim 60 may define a boundary of a hollow interior of the cap 34, providing a fluid passageway for a portion of the coolant. According to one embodiment, a filter membrane 62 may be placed above the rim 60, covering the rim 60. The filter membrane may be plastic, metal, or other materials. The filter membrane 62 may be a single sheet with holes formed therein, or alternatively, the filter membrane 62 may be a mesh or weave structure. The openings (either via holes or the space between the mesh or weave material) are sized to be large enough to permit the coolant to flow therethrough but small enough to prevent passage of the desiccant or contaminants.

The filter membrane 62 is fixed to cover the opening of the rim 60 via a collar 64. The collar 64 may be made of a thermoplastic, metallic (e.g., stainless steel, 3D-printed, etc.), thermoset, or other materials. The collar 64 covers a portion of the filter membrane 62 and connects directly to the rim 60 to secure the filter membrane 62 axially between the rim 60 and the collar 64. As will be described with reference to FIG. 4, the collar 64 can engage the rim 60 in a snap fashion, allowing an operator to press the collar 64 over the rim until a snap connection is made. This provides a secure fit between the collar 64 and the rim 60, but also allows the collar 64 to be removed or released from the rim 60 with proper force to bend the collar relative 64 to the rim 60.

The collar 64 includes an upper portion 66 that extends over a portion of the filter membrane 62, between the filter membrane 62 and the desiccant bag, for example. In one embodiment, the upper portion 66 includes an open (e.g., cylindrical) central region 68, and a plurality of linear legs 70 extending radially outward therefrom. While three legs 70 are shown in the figures, more or less than three legs 70 may be provided. The legs 70 extend from an external periphery of the central region 68. Gaps or openings 72 exist between each two adjacent legs 70. In other words, the openings 72 separate the legs 70.

The collar 64 provides protection to the filter membrane 62 during, for example, shipping of the caps 34. For example, if many of the caps 34 are shipped or handled together, contact between and amongst the caps 34 may be made, with the potential for an edge of the cap 34 to damage the filter membrane 62 of another cap 34. Therefore, the collar 64 is designed to cover and protect the filter membrane 62 from damage, while maintaining a minimal profile over the filter membrane 62 to not inadequately interfere with the operation of the filter membrane 62 during operation within the receiver drier 30. In one embodiment, a maximum distance between two adjacent legs 70 is less than an outer radius of the main body 50 of the cap 34. This can assure that if a first one of the caps 34 were to roll and contact an upper region of a second one of the caps 34 during shipment, legs 70 of the second cap would deflect the first cap away without contact being made on the filter membrane of the second cap. In other words, the distance between the legs 70 assures that no part of the rounded main body 50 of the cap 34 would be able to contact the filter membrane 62; the rounded main body 50 would instead contact the collar 64 without penetrating the collar 64 enough to contact the filter membrane 62.

Figure 4:
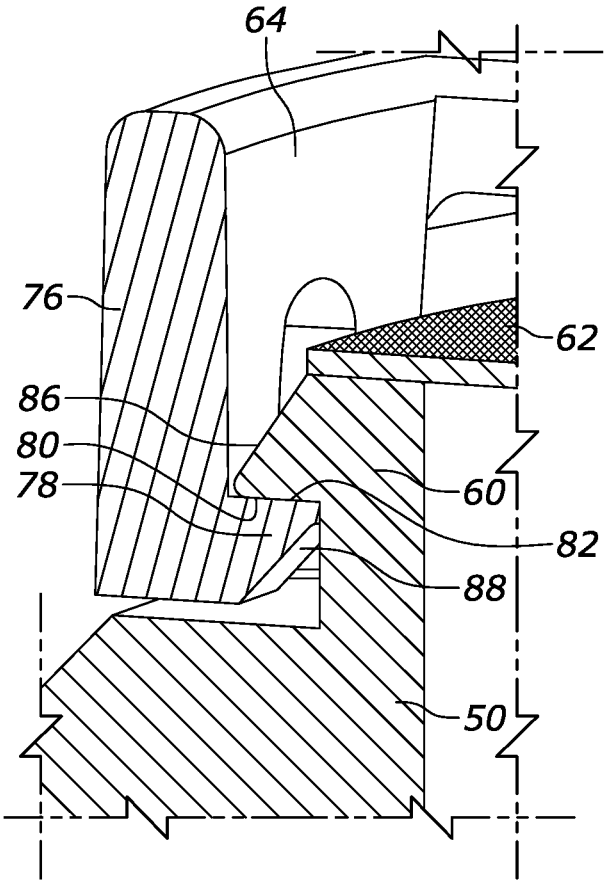
FIG. 4 illustrates a perspective cross-sectional view of the connection between the collar and the body of the cap, according to one embodiment.
Figure 5:
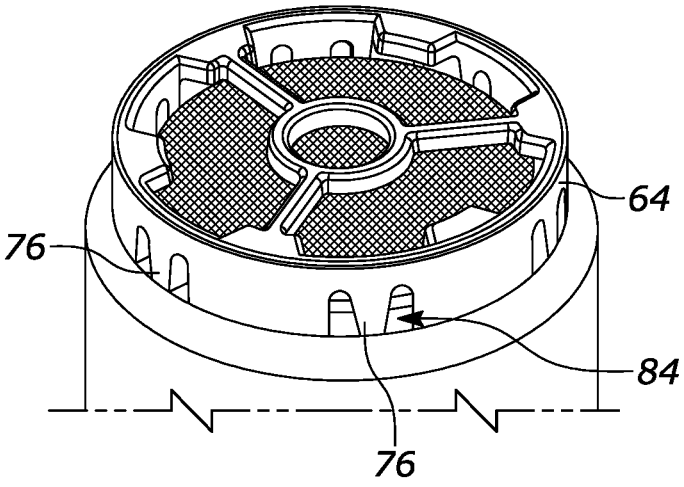
FIG. 5 illustrates a perspective view of a connection between the collar and the body of the cap, according to one embodiment.

Referring to FIGS. 4 and 5, the connection between the collar 64 and the main body 50 of the cap 34 is shown. The rim 60 is shown having an outwardly-extending portion that directly contacts and engages the collar 64. In particular, in one embodiment, the collar 64 includes a plurality of fingers 76 extending parallel to the center axis of the cap 34. Each finger 76 may include a shoulder 78 extending radially inward therefrom. The shoulder 78 may have an upper surface 80 that directly contacts a lower surface 82 of the rim 60. The fingers 76 may be located between a pair of gaps 84 formed in the collar 64. This provides the fingers 76 with flexibility that exceeds that of the remainder of the collar 64. This allows the fingers 76 to flex and bend over the rim 60.

During assembly, an operator can press the collar 64 over the rim 60. A tapered outer surface 86 of the rim 60 can contact a corresponding tapered inner surface 88 of each finger 76. This bends the fingers 76 outward, until the collar 64 is pressed over the rim 60. Once the tapered inner surfaces 88 have been pressed beyond the tapered outer surface 86 of the rim 60, the fingers can bend and "snap" back into place, in which the upper surface 80 of the shoulder 78 contacts the lower surface 82 of the rim. This provides a snap-fit engagement between the collar 64 and the rim 60 of the main body 50 of the cap. In one embodiment, only the fingers 76 have the shoulder 78 extending radially inward therefrom, but the remainder of the collar 64 does not include such a shoulder.

Figure 6:
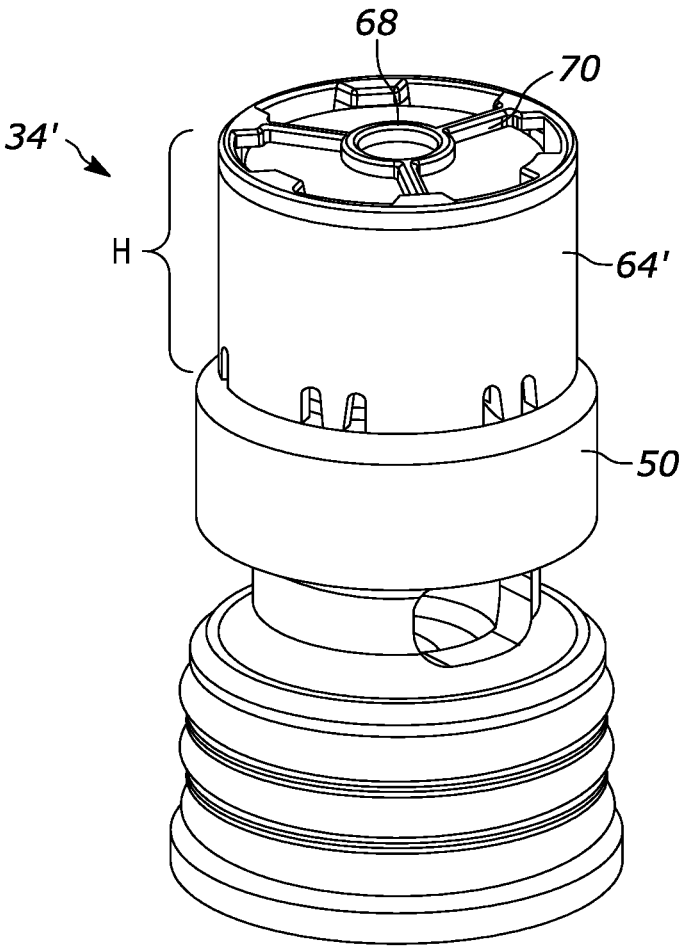
FIG. 6 illustrates a perspective view of a cap for the receiver drier, according to another embodiment with an extended, elongated collar.

FIG. 6 illustrates another embodiment of a cap 34'. The structure of the main body 50 may be identical to the embodiment shown in FIGS. 2-5, and therefore are not repeated with reference to FIG. 6 for brevity. The cap 34' of this embodiment is provided with a collar 64' with an extended height H. The height H may be greater than the outer radius of the collar 64'. This allows the collar 64' to act as a spacer, such that the filter membrane is contained within the collar 64' but not directly beneath the upper portion of the collar 64'. This also allows the desiccant bag to rest on the collar 64' without restricting flow of coolant through the filter membrane.

While a snap fit between the collar and the rim is disclosed herein, it should be understood that other connections methods are contemplated herein. For example, a separate fastener can be provided between the collar and the main body of the cap. In other embodiments, an adhesive is provided at the interface between the collar and the rim.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A filter cap for a body of a refrigerant tank of an automotive HVAC device, the filter cap comprising:

a main body including a threaded region configured to mate with a corresponding region of the automotive HVAC device, the main body having a rim defining an opening;

a filter membrane covering the opening; and a snap-on collar secured to and fitted about the rim, and at least partially covering the filter membrane to protect the filter membrane;

wherein the snap-on collar includes an upper portion that extends over the filter membrane, the upper portion including a plurality of legs with lengths extending in a radially outward direction with a plurality of openings defined between the legs such that the upper portion only partially covers the filter membrane; and wherein the snap-on collar includes a flexible finger that extends over, and secures with, an outer surface of the rim.

2. The filter cap of claim 1, wherein the finger includes a shoulder that releasably engages the rim.

3. The filter cap of claim 1, wherein the snap-on collar includes a main body, and the finger is more flexible than the main body.

4. The filter cap of claim 1, wherein a maximum distance between two of the legs is less than a radius of the main body of the filter cap.

5. A refrigerant tank for storing a refrigerant of a vehicular HVAC system, the refrigerant tank comprising:

a housing body defining therein a space for storing the refrigerant;

a desiccant bag disposed within the space of the housing body; and a filter cap inserted in and secured to the housing body, wherein the filter cap includes:

a main body having a rim defining an opening through which the refrigerant passes through, a filter membrane covering the opening of the main body, the filter membrane having a first surface having a length extending in a radial direction and a second surface spaced axially from the first surface and having a length extending in the radial direction, and a single-piece collar attached directly to the rim with a snap-fit and partially covering the filter membrane to protect the filter membrane, wherein the first surface sits on the main body of the filter cap, and the second surface is directly covered by the single-piece collar, and wherein the single-piece collar includes a flexible finger that extends over, and secures with, an outer surface of the rim with the snap-on fit.

6. The refrigerant tank of claim 5, wherein the flexible finger is configured to bend and secure around the rim.

7. The refrigerant tank of claim 6, wherein the finger includes an inwardly-protruding shoulder that directly contacts the rim.

8. The refrigerant tank of claim 5, wherein the desiccant bag directly contacts the collar.

9. The refrigerant tank of claim 5, wherein the collar includes an upper portion that has openings such that the upper portion only partially covers the filter membrane.

10. The refrigerant tank of claim 9, wherein the upper portion includes a plurality of legs extending in a radially outward direction, and the openings are provided between the legs.

11. The refrigerant tank of claim 10, wherein each adjacent pair of the plurality of legs is separated by a maximum distance that is less than a maximum radius of the main body of the filter cap.

12. The refrigerant tank of claim 10, wherein the desiccant bag directly contacts the legs.

13. A vehicular HVAC system comprising:

a filter cap configured to screw into a refrigerant tank of a heat exchanger assembly, the filter cap including a rim about an opening through which refrigerant passes;

a filter membrane disposed over the opening and configured to filter contaminants within the refrigerant; and a releasable protective cap covering the filter membrane and releasably attached to the rim of the filter cap, wherein the releasable protective cap includes a plurality of legs having lengths extending in a radial direction with gaps between and separating the legs, wherein two of the legs define a respective gap with maximum distance therebetween that is less than a maximum radius of the filter caps;

wherein the releasable protective cap defines a central axis and includes a plurality of fingers extending in an axial direction, each finger configured to extends over, and secure with, an outer surface of the rim.

14. The vehicular HVAC system of claim 13, wherein the releasable protective cap includes a cylindrical outer wall that defines a height and a radius, wherein the height exceeds the radius.

15. The vehicular HVAC system of claim 13, wherein a desiccant bag directly contacts the legs.

* * * * *